US005434586A

United States Patent [19]

Kinoshita et al.

[11] Patent Number: 5,434,586

[45] Date of Patent: Jul. 18, 1995

[54] MULTIBEAM ANTENNA FOR RECEIVING SATELLITE WAVES

[75] Inventors: Akira Kinoshita, Osaka; Mamoru Nomoto, Hirakata; Katsuhiko Tokuda, Osaka; Yoshikazu Yoshimura, Takatsuki, all of Japan

[73] Assignee: Matsushita Electric Industrial Co., Ltd., Osaka, Japan

[21] Appl. No.: 149,804

[22] Filed: Nov. 10, 1993

[30] Foreign Application Priority Data

Nov. 11, 1992 [JP] Japan ..... 4-300727

[51] Int. Cl.[6] ..... H01Q 19/12

[52] U.S. Cl. ..... 343/840; 343/781 R

[58] Field of Search ..... 343/779, 840, 781 R, 343/914; H01Q 19/12

[56] References Cited

U.S. PATENT DOCUMENTS

| | | | |
|---|---|---|---|
| 4,343,002 | 8/1982 | Luh | 343/753 |
| 4,618,866 | 10/1986 | Makino et al. | 343/840 |
| 4,638,322 | 1/1987 | Lamberty | 343/840 |
| 4,712,111 | 12/1987 | Ohta et al. | 343/840 |

FOREIGN PATENT DOCUMENTS

| | | |
|---|---|---|
| 53-77159 | 7/1978 | Japan . |
| 61-240721 | 10/1986 | Japan . |
| 2-60210 | 2/1990 | Japan . |
| 3-108805 | 5/1991 | Japan . |

*Primary Examiner*—Donald Hajec
*Assistant Examiner*—Tan Ho
*Attorney, Agent, or Firm*—Willian Brinks Hofer Gilson & Lione

[57] ABSTRACT

A multibeam antenna for simultaneously receiving waves from one or more communication satellites and a broadcast satellite, which are apart in their stationary orbit positions over the equator, is disclosed. The antenna employs an offset parabolic face, used as a reflector for receiving satellite broadcast waves, a converter having a primary radiator for receiving communication satellite Waves set at the focus point of the offset parabolic face, and a converter having a primary radiator for receiving broadcast satellite waves set near the envelope of the broadcast waves reflected from the offset parabolic face. The offset parabolic face is pointed in the direction of the communication satellite such that the plane of symmetry of the offset parabolic face is coincident with a plane specified by the communication satellite, the broadcast satellite, and the receiving point of the antenna. By utilizing this arrangement, an antenna that is relatively inexpensive to manufacture and is easily installable and adjustable may be obtained.

7 Claims, 6 Drawing Sheets

MULTIBEAM ANTENNA FOR RECEIVING SATELLITE WAVES

FIELD OF THE INVENTION

The present invention relates to a multibeam antenna for receiving electromagnetic waves from a plurality of satellites, and more particularly to a multibeam antenna capable of receiving waves from both broadcast satellites and communication satellites simultaneously.

BACKGROUND OF THE INVENTION

In recent years the television and radio broadcasting industries have begun to utilize communication satellites for broadcasting, as an alternative to standard broadcasting using broadcast satellites. Broadcast satellites and communication satellites are separated by a 50 to 60 degree radius in their respective stationary orbits over the equator. Communication satellites are attractive for use in broadcasting because there is typically only about a four degree difference in position between two such satellites. However, a drawback to using communication satellites is that their effective radiation power (dBW) is about 50 dBW in the center of Japan, which is about 10 dBW less than the standard radiation power of broadcast satellites (60 dBW). Thus, it is desirable to utilize an antenna that is capable of receiving waves from both communication and broadcast satellites.

An antenna for receiving electromagnetic waves simultaneously from a plurality of satellites located in different stationary orbit positions is shown in FIGS. 1A–1C. FIGS. 1A–1C depict front, top and side views of this type of antenna. As illustrated therein, an antenna 60 has a torus face 61 acting as a reflector, the torus face 61 having a plurality of focus points for the waves emanating from the satellites. Converters 2 and 3 each have a primary radiator located on the focus points corresponding to the direction of the waves coming from each satellite. Supporting arms 4 support the converters 2 and 3, while the antenna pole 5 supports the antenna 60 itself.

Antennas of the type employing a torus face or the like for a reflector are problematic in that they are expensive to manufacture and difficult to install. Particularly because of the complexity of the surface of a torus face, a tooling die for such a device is very costly.

Further, this type of prior art antenna is very difficult to properly install and adjust. Of course, it is well known that the direction of the antenna must be set so that a sufficient receiving sensitivity is obtained for the incoming satellite waves. This must be done upon initial installation of the antenna and during subsequent adjustments.

When an antenna is to receive waves from both communication and broadcast satellites, the antenna must be directed at the communication satellite. Moreover, this type of prior art antenna also requires that the converter for the broadcast satellite be set on a particular focus point of the antenna. Therefore, this type of antenna must also be directed to the broadcast satellite as well. In order to successfully accomplish this, an azimuth angle, an angle of elevation, and a polarization angle of the antenna direction must all be properly adjusted. This has proven to be sensitive, time consuming work.

Thus, there exists a need in the art for a multibeam antenna that not only can simultaneously receive electromagnetic waves from a plurality of satellites, of both the broadcast and communication type, but can also be manufactured at low cost and easily installed and adjusted.

SUMMARY OF THE INVENTION

A general object of the present invention is therefore to provide a multibeam antenna for simultaneously receiving electromagnetic waves from a plurality of broadcast and communication satellites.

Another object of the present invention is to provide a multibeam antenna of this type which is capable of being manufactured at a relatively low cost.

A further object of the present invention is to provide a multibeam antenna of this type that facilitates ease of installation and adjustment.

To accomplish the foregoing objectives, a preferred embodiment of the present invention comprises:

- a multibeam antenna for receiving satellite waves, having an offset parabolic face acting as a reflector;
- at least one converter having a primary radiator for receiving communication satellite waves, set in the vicinity of a focus point of the offset parabolic face; and
- a converter having a primary radiator for receiving broadcast satellite waves, set in the envelope of broadcast waves reflected from said offset parabolic face, wherein the offset parabolic face is pointed in the direction of an antenna aiming point which is in the vicinity of the communication satellite, such that a plane of symmetry of the offset parabolic face is coincident with a plane determined by the antenna aiming point, the broadcast satellite, and the receiving point of the antenna.

Other embodiments of the present invention are possible. In an alternative embodiment, the antenna is installed such that the longer symmetric axis of the plane of symmetry of the offset parabolic face is set in a horizontal position. This arrangement allows for installation by merely adjusting an azimuth angle of the antenna and its angle of elevation.

The invention itself, together with further objects and attendant advantages, will best be understood by reference to the following detailed description of the preferred embodiments, taken in conjunction with the accompanying drawings.

DESCRIPTION OF THE PREFERRED EMBODIMENTS

Figure 1A:
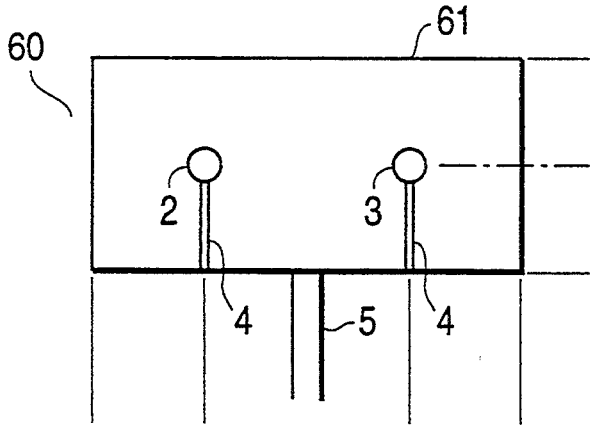
FIG. 1(A) PRIOR ART
FIGS. 1A, 1B, and 1C depict an antenna in accordance with the prior art, representing a front view, top view, and side view, respectively.
Figure 1C:
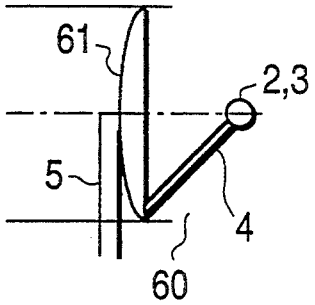
FIG. 1(C) PRIOR ART
Figure 1B:
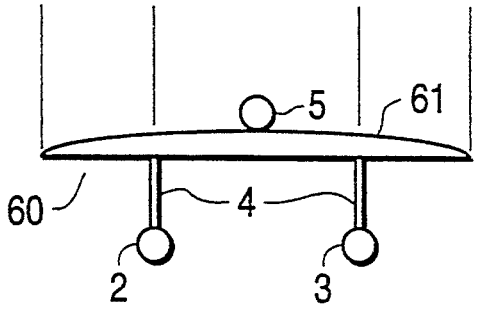
FIG. 1(B) PRIOR ART
Figure 2:
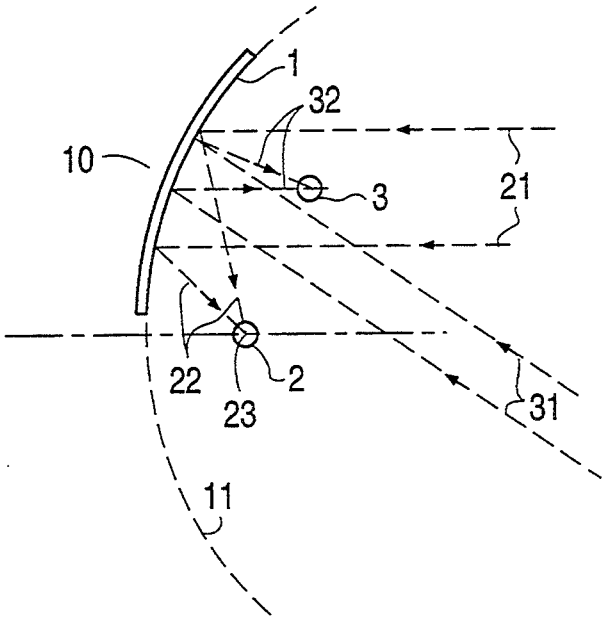
FIG. 2 is a side view of a multibeam antenna having an offset parabolic face in accordance with the present invention, wherein the plane of symmetry of the offset parabolic face is in a vertical direction.

Referring now to the drawings, FIG. 2 is a side view of a multibeam antenna 10 having an offset parabolic face 1 in accordance with the present invention. In FIG. 2, the plane of symmetry of the offset parabolic face 1 is set in a vertical position. A broken line 11 represents the path of the rotated offset parabolic face, the actual position of the offset parabolic face 1 being located on the broken line 11. As defined herein, the "plane of symmetry" includes the longer axis of the antenna aperture. Other details of FIG. 2 will be described in more detail later.

Use of the offset parabolic face 1 overcomes one of the difficulties of the prior art devices which utilize the costly torus faces. Because of the simplicity of a parabolic face, a tooling die for such a device is much easier to construct, and therefore is much less costly than the tooling die for a torus face. In addition, because parabolic faces are already in use as antennas for receiving waves from a single broadcast satellite, antenna manufacturers will most likely already be in possession of a tooling die for such a parabolic face. Thus, manufacturers will be able to divert an already existing tooling die for use in manufacturing the multibeam antenna of the present invention.

Figure 3A:
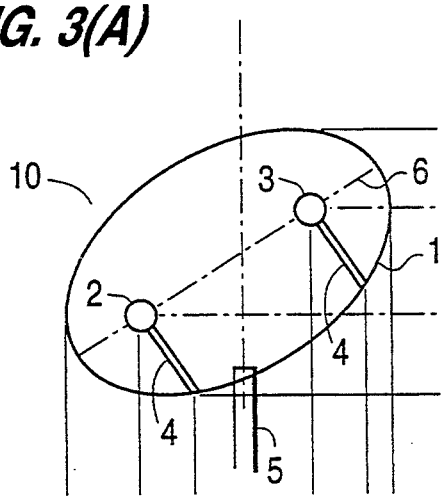
FIGS. 3A, 3B and 3C are drawings of a front view, top view, and side view of an antenna in accordance with a first preferred embodiment of the present invention, wherein one communication satellite is to be utilized.
Figure 3C:
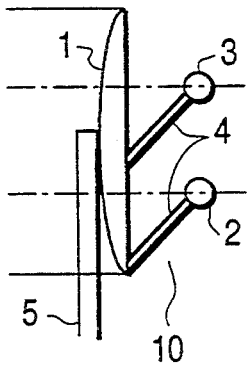
Figure 3B:
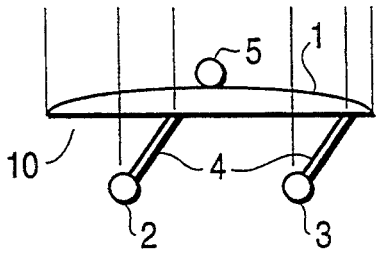

FIGS. 3A, 3B, and 3C represent front, top, and side views of the first preferred embodiment of the present invention. In these figures, ,one communication satellite and one broadcast satellite are to be utilized. The multibeam antenna 10 shown in FIGS. 3A–3C has an offset parabolic face 1, a converter 2 having a primary radiator for receiving the emitted communication satellite waves, and a converter 3 having a primary radiator for receiving the emitted broadcast satellite waves. Supporting arms 4 support the converters 2 and 3, while the antenna pole 5 supports the antenna 10 itself. A line 6 represents a cross line between the offset parabolic face 1 and the plane of symmetry of the offset parabolic face 1. As previously stated, the plane of symmetry of the offset parabolic face 1 includes the longer axis of the antenna aperture.

As shown in FIG. 3A, the offset parabolic face 1 will be pointed in the direction of the communication satellite (not shown), such that the plane of symmetry of the offset parabolic face 1 will be coincident with a plane identified by three points: (1) the antenna aiming point (which in this example is the communication satellite); (2) the broadcast satellite; and (3) the receiving point of the antenna.

By utilizing this arrangement, an aperture of the antenna pointing in the direction of the broadcast satellite may be made relatively large without changing the size of the aperture of the antenna pointing in the direction of the communication satellite. This arrangement therefore ensures reception by the antenna of waves from both communication and broadcast satellites simultaneously. Of course, it should be understood that the receiving point of the antenna is the place where the antenna is installed for receiving the satellite waves.

Figure 4:
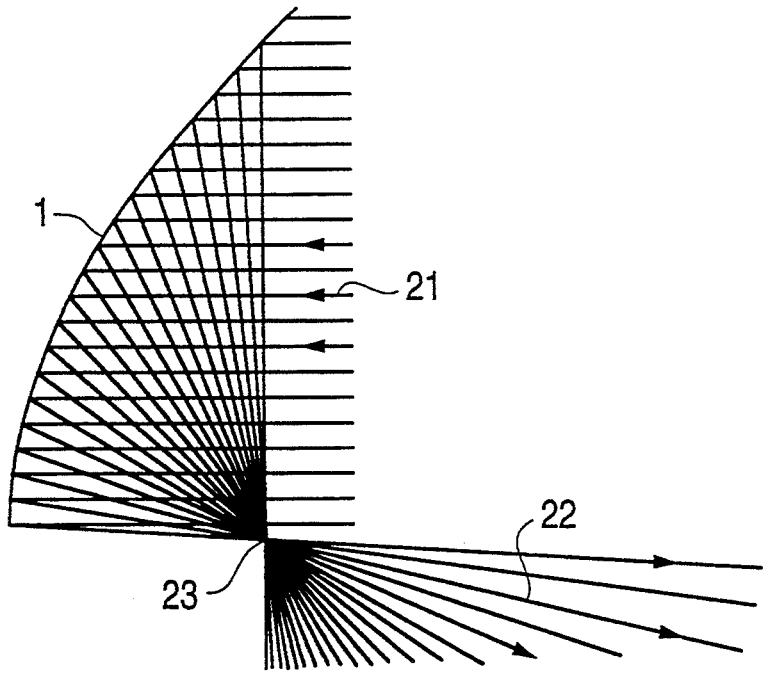
FIG. 4 illustrates a reflection of an electromagnetic wave from a communication satellite in accordance with the first preferred embodiment of the present invention.
Figure 5:
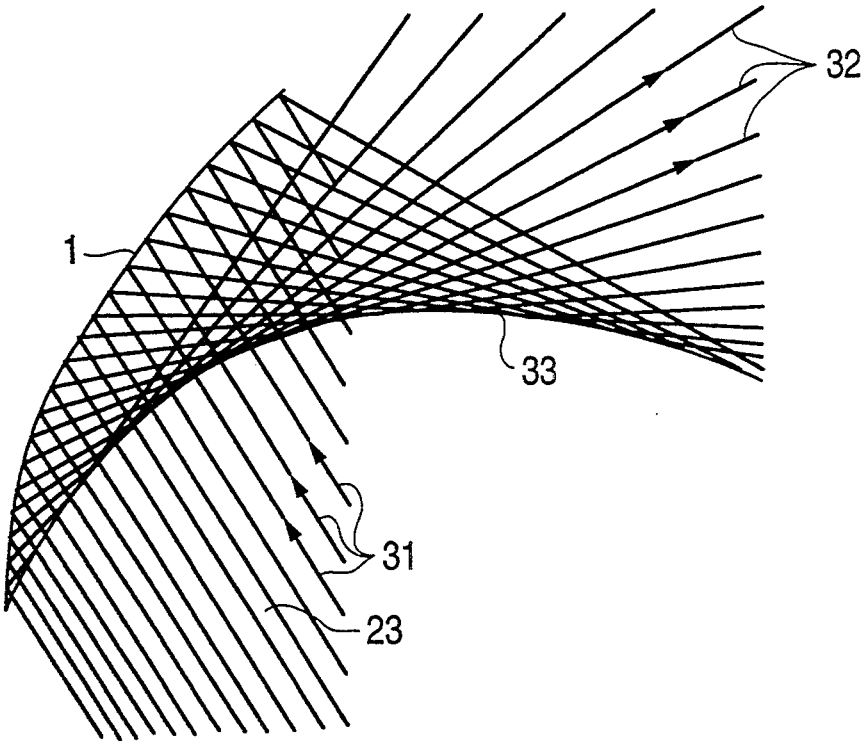
FIG. 5 illustrates a reflection of an electromagnetic wave from a broadcast satellite in accordance with the first preferred embodiment of the present invention.

FIGS. 4 and 5 illustrate reflections of electromagnetic waves from the offset parabolic face 1 of the antenna into the plane of symmetry. FIG. 4 represents reflections from waves emitted by a communication satellite, while FIG. 5 represents reflections of waves emitted by a broadcast satellite. With reference to FIG. 4, as the wave 21 emitted from the communication satellite reflects off the offset parabolic face 1, the reflected wave 22 will focus at the focus point 23 of the offset parabolic face 1. Referring back to FIG. 2, the converter 2 having a primary radiator for receiving a communication satellite wave 21 is therefore set at or near the focus point 23 of the offset parabolic face 1. Thus, the converter 2 will detect the reflected wave 22 from the communication satellite.

With respect to FIG. 5, the electromagnetic wave 31 from the broadcast satellite will not focus at a single point after reflection by the offset parabolic face 1, as depicted by reflected broadcast waves 32. However, because the effective radiation power of the broadcast satellite is greater compared to that of the communication satellite, a sufficient sensitivity of reception of the reflected broadcast wave 32 will be obtained if the converter 3 having a primary radiator for receiving a broadcast satellite wave 31 is set near the envelope 33 of the reflected broadcast wave 32.

This arrangement differs from the prior art antennas, which require that the antenna be directed so that converters for both communication waves and broadcast waves are set at focus points. By relying on the greater radiation power of the broadcast waves, the present invention requires that the antenna be directed only at the communication satellite. This allows the antenna to be installed such that it is pointing only in the direction of the communication satellite, such that the plane of symmetry of the antenna is coincident with the plane determined by three points: the broadcast satellite, the communication satellite (which is the antenna aiming point) and the receiving point of the antenna. The antenna is rotated about the axis which connects the receiving point and the communication satellite, after the antenna has been correctly directed at the communication satellite.

In actual implementation, the antenna will be directed so that a maximum sensitivity for the waves emanating from the communication satellite is achieved. The antenna is then rotated around the axis which connects the converter 2 (for receiving the waves from the communication satellite) and the communication satellite itself, until a maximum sensitivity is also obtained for the waves from the broadcast satellite.

Figure 6A:
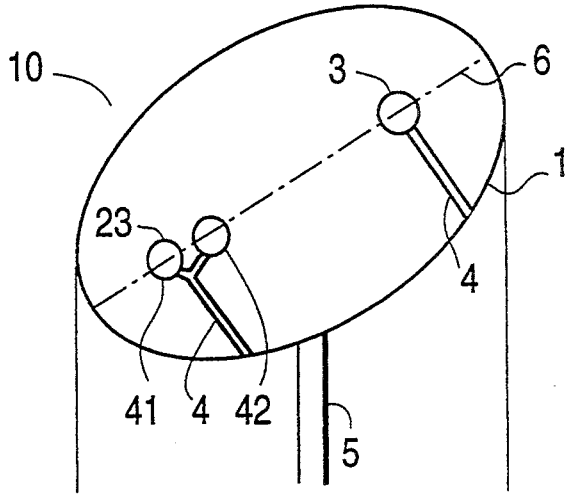
FIGS. 6A and 6B are drawings of a front view and top view of an antenna in accordance with a first preferred embodiment of the present invention, wherein two communication satellites are to be utilized.
Figure 6B:
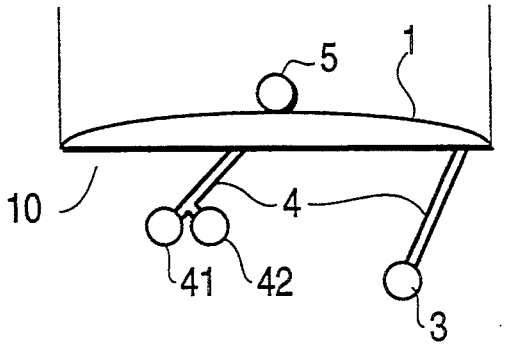

FIGS. 6A and 6B depict a multibeam antenna 10 according to the first preferred embodiment of the present invention wherein two communication satellites will be utilized. The set-up of the antenna 10 is the same as that when one communication satellite is used, except that two converters 41, 42 are employed, each having a primary radiator for receiving waves corresponding to each communication satellite. The converters 41, 42 are set in the vicinity of the focus point 23 of the offset parabolic face 1. In this case, the offset parabolic face 1 will be pointed in the direction of the midpoint of the two communication satellites (i.e., the antenna aiming point).

According to the first preferred embodiment of the present invention, an antenna for simultaneously receiving waves from one or more communication satellites and a broadcast satellite (which are apart in their stationary orbit positions over the equator) is achieved. The antenna employs an offset parabolic face, used as a reflector for receiving satellite broadcast waves, a converter having a primary radiator for receiving communication satellite waves set at the focus point of the offset parabolic face, and a converter having a primary radiator for receiving broadcast satellite waves set near the envelope of the broadcast waves reflected from the offset parabolic face. The offset parabolic face is pointed in the direction of the communication satellite (or at the midpoint of the communication satellites if two are utilized), such that the plane of symmetry of the offset parabolic face is coincident with a plane specified by three points: (1) the antenna aiming point (which is either the communication satellite or the midpoint of the two communication satellites); (2) the broadcast satellite; and (3) the receiving point of the antenna. By utilizing this arrangement, an antenna that is relatively inexpensive to manufacture and is easily installable and adjustable is obtained.

Figure 7A:
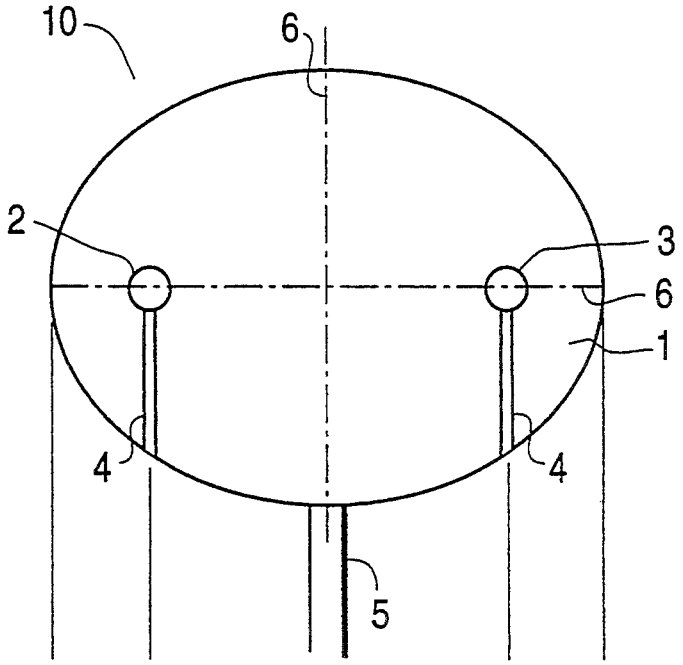
FIGS. 7A and 7B are front and top views of an antenna in accordance with a second preferred embodiment of the present invention.
Figure 7B:
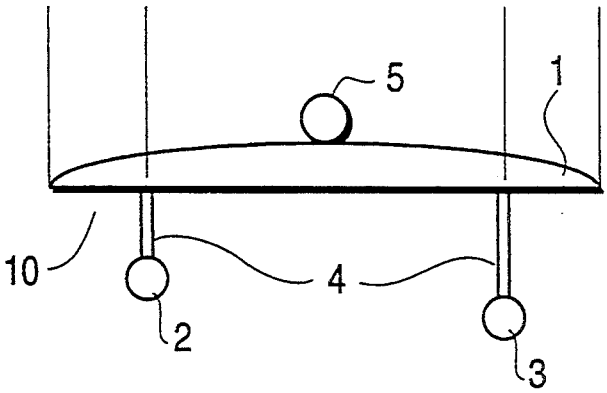

A second preferred embodiment of the present invention is depicted in FIGS. 7A and 7B. The arrangement of the antenna itself in this embodiment is the same as that disclosed in FIG. 3. However, in this embodiment, the antenna 10 is installed so that the longer symmetric axis of the plane of symmetry of the offset parabolic face 1, which is pointed in the direction of a communication satellite, is set in a horizontal direction. The line 6 represents a cross line between the offset parabolic face 1 and the plane of symmetry of the offset parabolic face 1. Although in this arrangement the sensitivity of reception of the broadcast satellite wave is less than in the first embodiment, the antenna may be installed by merely adjusting an azimuth angle of the antenna and its angle of elevation. Thus, the second preferred embodiment results in an even greater ease of installation and adjustment.

Figure 8:
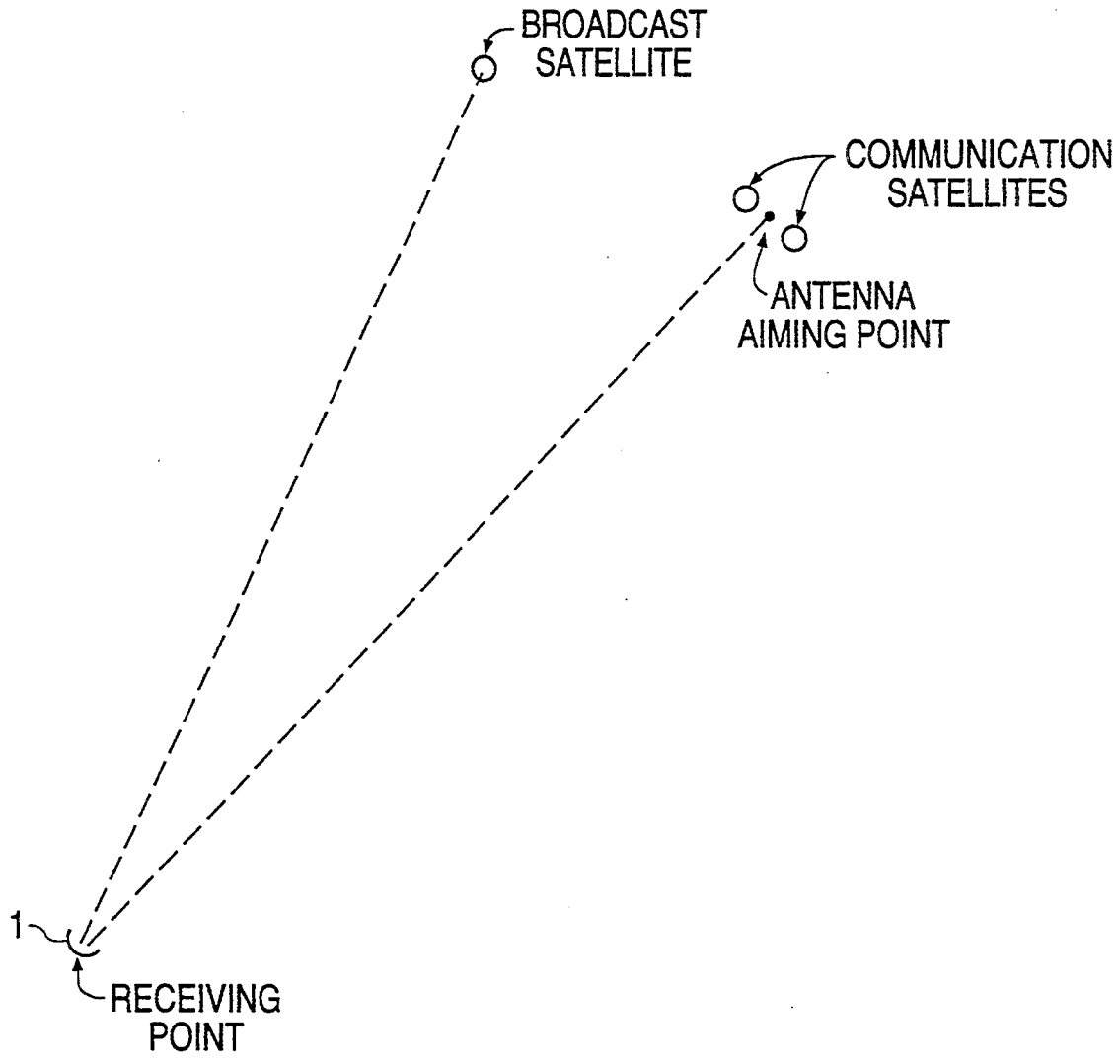
FIG. 8 is a drawing which depicts the relation between the antenna aiming point, the broadcast satellite, and the receiving point of the antenna.

FIG. 8 represents the relationship between the three points that define the plane of symmetry of the offset parabolic face 1. The receiving point is the antenna itself, and specifically the offset parabolic face 1. The second point is the antenna aiming point, which will be either the communication satellite (if there is only one) or the midpoint between the communication satellites (if there are more than one). The third point is the broadcast satellite. The plane of symmetry of the offset parabolic face 1 is coincident with the plane specified by these three points.

To summarize the present invention, an antenna for simultaneously receiving waves from one or more communication satellites and a broadcast satellite, which are different in their stationary orbit positions over the equator, utilizes an offset parabolic face acting as a reflector for receiving satellite broadcast waves. A converter having a primary radiator for receiving communication satellite waves is set at the focus point of the offset parabolic face, and a converter having a primary radiator for receiving broadcast satellite waves is set near the envelope of the broadcast waves reflected from the offset parabolic face. The offset parabolic face is directed to an antenna aiming point such that:

(a) the plane of symmetry of the offset parabolic face is coincident with a plane determined by the antenna aiming point, the broadcast satellite, and the receiving point of the antenna; or (b) the longer symmetric axis of the plane of symmetry of the offset parabolic face is set in a horizontal direction, and the antenna aiming point is the communication satellite itself when only one communication satellite is used, and is the midpoint of the communication satellites when a plurality are utilized.

The embodiments described above provide a number of significant advantages. According to the invention, electromagnetic waves from both communication and broadcast satellites may be simultaneously received. The disclosed antenna may be manufactured at a relatively low cost compared with heretofore known antennas, due to the utilization of the offset parabolic face. The described antenna is further advantageous in that it may be easily installed and adjusted, due to the fact that the effective radiation power of the broadcast satellite is greater compared to that of the communication satellite. Because of this, the antenna does not have to be set so that it is directed at both the broadcast satellite and the communication satellite.

The present invention may be embodied in other specific forms without departing from the spirit or essential characteristics thereof. The present embodiments are therefore to be considered in all respects as illustrative and not restrictive, the scope of the invention being indicated by the appended claims rather than the foregoing description, and all changes which come within the meaning and range of equivalency of the claims are therefore intended to be embraced therein.

What is claimed is:

1. A multibeam antenna for receiving satellite broadcast waves comprising:

an offset parabolic face acting as a reflector for simultaneously receiving waves from at least one communication satellite and waves from a broadcast satellite;

a converter having a primary radiator for receiving said communication satellite waves, said converter being set at a focus point of said offset parabolic face; and a second converter having a primary radiator for receiving said broadcast satellite waves, said second converter being set near an envelope of the broadcast satellite waves being reflected from said offset parabolic face, wherein the offset parabolic face is pointed in the direction of an antenna aiming point which is determined by the location of said at least one communication satellite, such that a plane of symmetry of said offset parabolic face is coincident with a plane determined by the antenna aiming point, the broadcast satellite, and a receiving point of the antenna.

2. The multibeam antenna according to claim 1, wherein an aperture of the antenna pointing in the direction of the broadcast satellite may be made large without changing the size of an aperture of the antenna pointing in the direction of the communication satellite.

3. A multibeam antenna for receiving satellite broadcast waves comprising:

an offset parabolic face acting as a reflector for simultaneously receiving waves from at least one communication satellite and waves from a broadcast satellite;

a converter having a primary radiator for receiving said communication satellite waves, said converter being set at a focus point of said offset parabolic face; and a second converter having a primary radiator for receiving said broadcast satellite waves, said second converter being set near an envelope of the broadcast satellite waves being reflected from said offset parabolic face, wherein the offset parabolic face is pointed in the direction of an antenna aiming point which is determined by the location of said at least one communication satellite, and a longer symmetric axis of a plane of symmetry of the offset parabolic face is set in a horizontal direction.

4. A multibeam antenna for receiving satellite broadcast waves comprising:

an offset parabolic face acting as a reflector for simultaneously receiving waves from a plurality of communication satellites and waves from a broadcast satellite;

a plurality of converters each having a primary radiator corresponding to said plurality of communication satellites for receiving said waves from said communication satellites, said converters being set at a focus point of said offset parabolic face; and a converter having a primary radiator for receiving said broadcast satellite waves, said converter being set near an envelope of the broadcast satellite waves being reflected from said offset parabolic face, wherein the offset parabolic face is pointed in the direction of an antenna aiming point which is determined by the location of said plurality of communication satellites, such that a plane of symmetry of said offset parabolic face is coincident with a plane determined by the antenna aiming point, the broadcast satellite, and a receiving point of the antenna.

5. The multibeam antenna according to claim 4, wherein an aperture of the antenna pointing in the direction of the broadcast satellite may be made large without changing the size of an aperture of the antenna pointing in the direction of the communication satellites.

6. A multibeam antenna for receiving satellite broadcast waves comprising:

parabolic face means acting as a reflector for simultaneously receiving waves from at least one communication satellite and waves from a broadcast satellite;

converting means having radiator means for receiving said communication satellite waves, said converting means being set at a focus point of said parabolic face means; and second converting means having radiator means for receiving said broadcast satellite waves, said second converting means being set near an envelope of the broadcast satellite waves being reflected from said parabolic face means, wherein the parabolic face means is pointed in the direction of an antenna aiming point which is determined by the location of said at least one communication satellite, such that a plane of symmetry of said parabolic face means is coincident with a plane determined by the antenna aiming point, the broadcast satellite, and a receiving point of the antenna.

7. The multibeam antenna according to claim 6, wherein an aperture of the antenna pointing in the direction of the broadcast satellite may be made large without changing the size of an aperture of the antenna pointing in the direction of the communication satellite.

* * * * *